United States Patent [19]

D'Orta

[11] Patent Number: 4,986,537

[45] Date of Patent: Jan. 22, 1991

[54] SIDEWINDER EXERCISER

[76] Inventor: Frank D'Orta, 69 Molle St., W. Babylon, N.Y. 11704

[21] Appl. No.: 468,018

[22] Filed: Jan. 22, 1990

[51] Int. Cl.[5] ..... A63B 21/015

[52] U.S. Cl. ..... 272/132; 272/119

[58] Field of Search ..... 272/93, 94, 99, 119, 272/132, 135–143; 128/77, 78

[56] References Cited

U.S. PATENT DOCUMENTS

| | | | |
|---|---|---|---|
| 2,097,376 | 10/1937 | Marshman | 272/139 |
| 2,576,024 | 11/1951 | Laser | 272/119 X |
| 2,832,334 | 4/1958 | Whitelaw | 272/132 X |
| 3,224,765 | 12/1965 | Baker et al. | 272/132 |
| 4,506,883 | 3/1985 | Rathbun | 272/99 |
| 4,606,542 | 8/1986 | Segal | 272/119 X |
| 4,624,246 | 11/1986 | Ajemian | 128/78 X |
| 4,718,665 | 1/1988 | Airy et al. | 272/132 |
| 4,801,138 | 1/1989 | Airy et al. | 272/132 X |
| 4,905,678 | 3/1990 | Cumins et al. | 128/78 |

*Primary Examiner*—Robert Bahr

*Attorney, Agent, or Firm*—Michael I. Kroll

[57] ABSTRACT

The present invention is an exerciser for a user. It has a main body that includes a main frame, a top portion, a bottom portion, and an intermediate portion. The bottom portion contains only one single lower belt rung and only one second lock pin. The single lower belt rung is steel. Belt rungs attach the main body to the user so that the user can exercise inconspicuously. The top portion contains a pair of upper belt rungs and a first lock pin. Additionally, included is an "S"-shaped bar having a free end at which said "S"-shaped bar is pivotally connected to a crank handle which is gripped by the user.

15 Claims, 2 Drawing Sheets

SIDEWINDER EXERCISER

BACKGROUND OF THE INVENTION

1. Field of the Invention

The present invention relates to exercising.

More particularly, the present invention relates to an exercising device that is inconspicuous.

2. Description of the Prior Art

Numerous innovations for exercising devices have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide a sidewinder exercises that avoids the disadvantages of the prior art.

More particularly, it is an object of the present invention to provide an exerciser that can be used inconspicuously when the user is involved either in an active mode or a passive mode. The sidewinder exerciser of the present invention exerises muscles in the hands, lower and upper arms, shoulders, back, and chest. Cardiovascular health can be improved through the use of aerobic exercising with the sidewinder exerciser of the present invention.

In keeping with these objects, and with others which will become apparent hereinafter, one feature of the present invention resides, briefly stated, in an exerciser for a user, having a main body, wherein means are provided for attaching the main body to the user.

When the sidewinder exerciser is designed in accordance with the present invention, the user can exercise inconspicuously.

In accordance with another feature of the present invention, the attaching means include an upper belt with a first upper buckle, a first lower belt with a first lower buckle, and a second lower belt with a second lock buckle so that the main bodY is fitted snugly to the user for inconspicuous use.

Another feature of the present invention is that the main body includes a top portion, a bottom portion, an intermediate portion, and a main frame.

Yet another feature of the present invention is that the top portion contains a pair of upper belt rungs and a first lock pin.

Still another feature of the present invention is that the pair of upper belt rungs are steel.

Yet still another feature of the present invention is that the bottom portion contains a single lower belt rung and a second lock pin.

Still yet another feature of the present invention is that the single lower belt rung is steel.

Another feature of the present invention is that the intermediate portion contains a round disk, a first caliper half, a second caliper half, and a pair of anchor screws and nuts.

Yet another feature of the present invention is that the round disk contains a first throughbore and a second throughbore.

Still another feature of the present invention is that it further includes an "S"-shaped bar having a free end at which the "S"-shaped bar is pivotally connected to a crank handle which is gripped by the user.

Yet still another feature of the present invention is that the "S"-shaped bar is metal.

Still yet another feature of the present invention is that the "S"-shaped bar has a fixed end that contains a second throughbore and a first throughbore.

Another feature of the present invention is that it further comprises a center bolt that passes through the first throughbore in the "S"-shaped bar, and then through the round disk, and ultimately into the main frame.

Yet another feature of the present invention is that the first caliper half and the second caliper half are substantially crescent shaped.

Still another feature of the present invention is that the first caliper half has a fixed end containing a first mounting throughbore with a corresponding throughbore contained in the main frame.

Yet still another feature of the present invention is that a first anchor screw passes through the first mounting throughbore and into the main frame.

Still yet another feature of the present invention is that the second caliper has a fixed end containing a second mounting throughbore with a corresponding throughbore contained in the main frame.

Another feature of the present invention is that a second anchor screw passes through the second mounting throughbore and into the main frame.

Yet another feature of the present invention is that a second anchor screw passes through the second mounting throughbore and into the main frame.

Still another feature of the present invention is that the first caliper half is retained from motion by an anchor that passes through the first caliper half and into the main frame.

Yet still another feature of the present invention is that the first caliper half includes a first flange disposed on the free end of the first caliper half.

Still yet another feature of the present invention is that the first flange contains a throughbore.

Another feature of the present invention is that the second caliper half includes a second flange disposed on the free end of the second caliper half.

Still another feature of the present invention is that the second flange contains a throughbore.

Yet still another feature of the present invention is that it further comprises a set screw having a sleeve and passes through the throughbore of the first flange and the throughbore of the second flange where it is locked by a nut.

The novel features which are considered characteristic for the invention ar set forth in particular in the appended claims. The invention itself, however, both as to its construction and its method of operation, together with additional objects and advantages thereof, will be best understood from the following description of the specific embodiments when read in connection with the accompanying drawing.

LIST OF REFERENCE NUMERALS UTILIZED IN THE DRAWING

Figure 1:
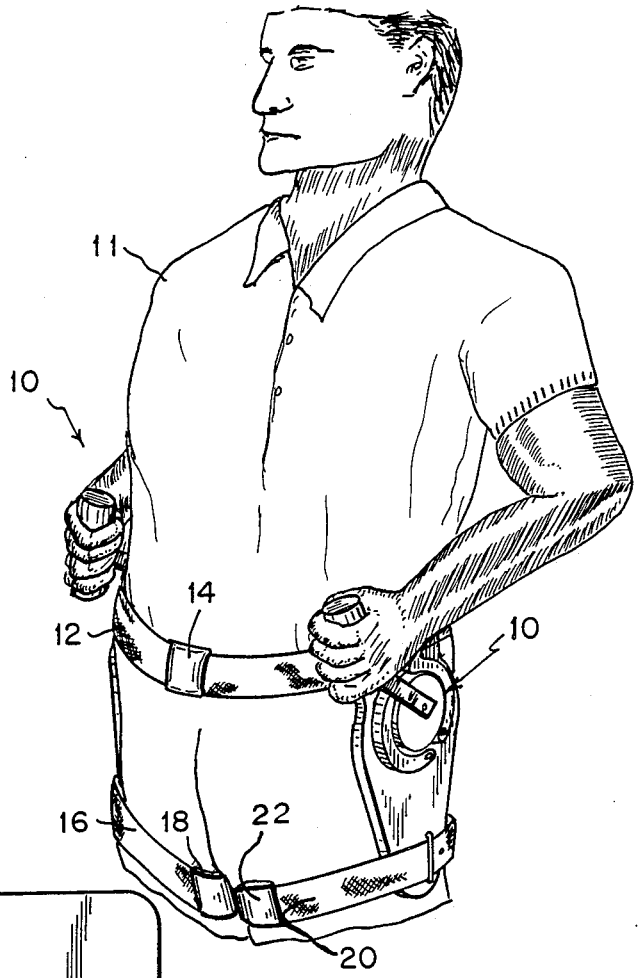
FIG. 1 is a perspective view of the user wearing a pair of sidewinder exercisers of the present invention.

10—sidewinder exerciser of the present invention
11—user of the sidewinder exerciser 10
12—upper belt of the sidewinder exerciser 10
14—first upper buckle for the upper belt 12
16—first lower belt
18—first lower buckle for the first lower belt 16
20—second lower belt
22—second lower buckle for the second lower belt 20
24—main frame of the sidewinder exerciser 10
26—specific configuration of the main frame 24
28—top portion of the main frame 24
30—bottom portion of the main frame 24
32—intermediate portion of the main frame 24
33—single steel lower belt rung
34—pair of upper belt rungs
36—first lock pin for upper belt 12
37—second lock pin for lower belt 12
38—round disk
40—first caliper half
42—second caliper half
44—pair of anchor screws and nuts
46—first throughbore in round dish 38
48—second throughbore in round dish 38
50—center bolt
52—"S"-shaped metal bar (offset)
54—free end of "S"-shaped metal bar 52
56—crank handle of "S"-shaped metal bar 52
58—pivot screw attaching crank handle 56 to the "S"-shaped metal bar 52
60—fixed end of the "S"-shaped metal bar 52
62—second throughbore in the "S"-shaped metal bar 52
64—first throughbore in the "S"-shaped metal bar 52
70—fixed end of the first caliper half 40
71—lock pin on the second half caliper 42
72—first mounting throughbore
74—throughbore in main frame 24 corresponding to first mounting throughbore 72
75—second mounting throughbore
76—fixed end of second caliper half 42
80—throughbore in main frame 24 corresponding to second mounting throughbore 75
82—first anchor screw
84—second anchor screw
86—first flange of first caliper half 40
88—free end of first caliper half 40
90—throughbore in the first flange 86
91—sleeve
92—second flange of second caliper half 42
93—set screw
94—free end of second caliper half 42
96—throughbore in the second flange 92
98—throughbore in the first flange 86
100—nut locking set screw 93

DETAILED DESCRIPTION OF THE PREFERRED EMBODIMENT

Referring now to FIG. 1, the sidewinder exerciser of the present invention is shown generally at 10, and worn by a user 11 in a somewhat conventional fashion.

An upper belt 12 has a first upper buckle 14. A first lower belt 16 has a first lower buckle 18. A second lower belt 20 has a second lower buckle 22.

Figure 2:
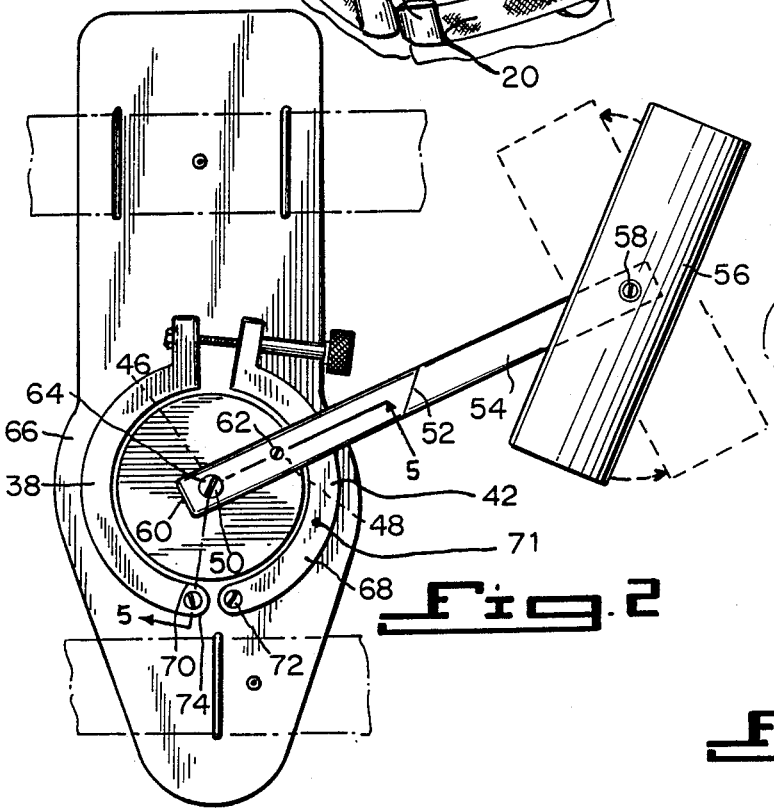
FIG. 2 is a front view of the sidewinder exerciser of the present invention, shown in FIG. 1.
Figure 3:
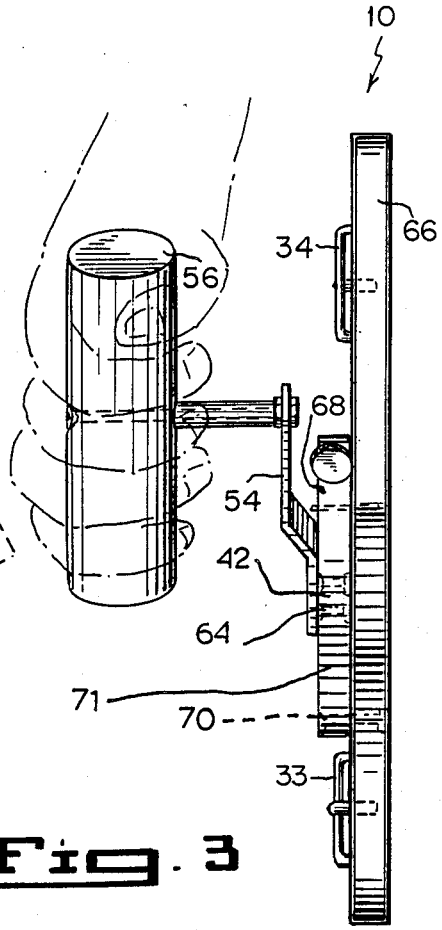
FIG. 3 is a side view of a sidewinder exerciser of the present invention, shown in FIGS. 1 and 2.
Figure 4:
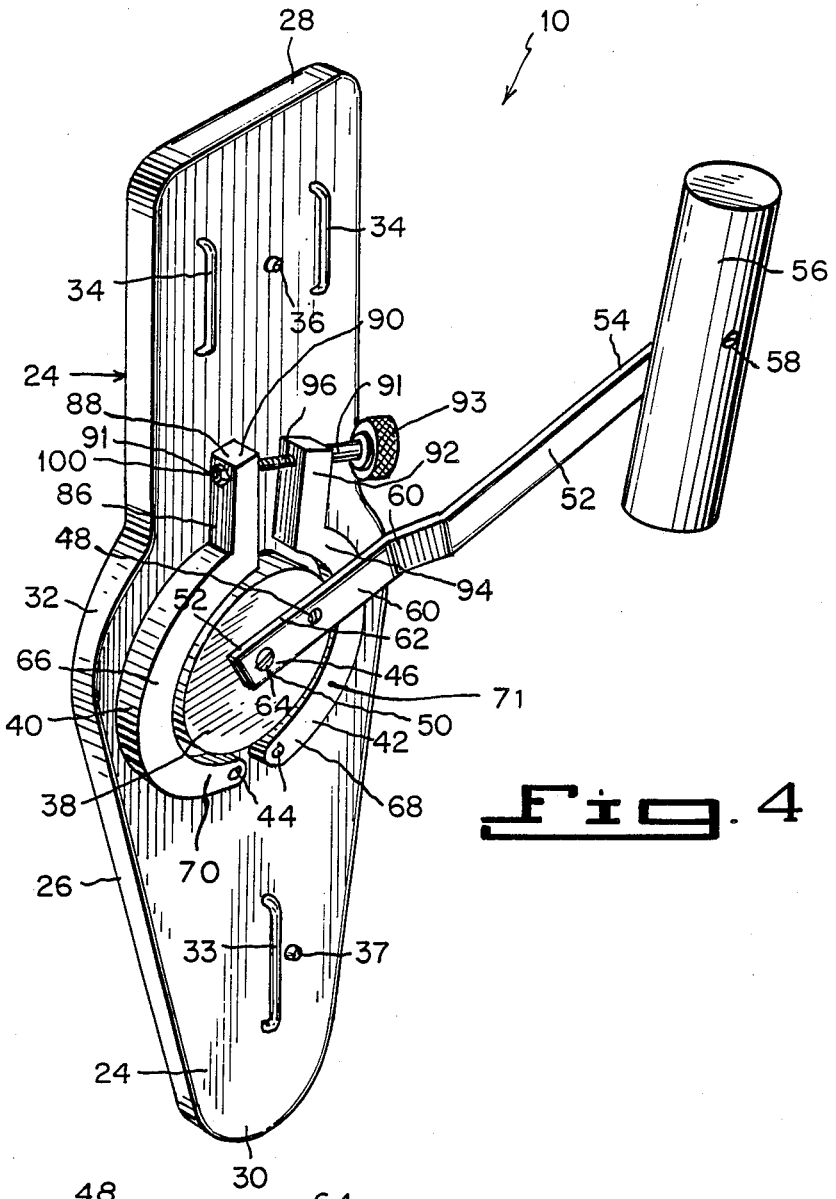
FIG. 4 is a perspective view of a sidewinder exerciser of the present invention, shown in FIGS. 1 through 3.
Figure 5:
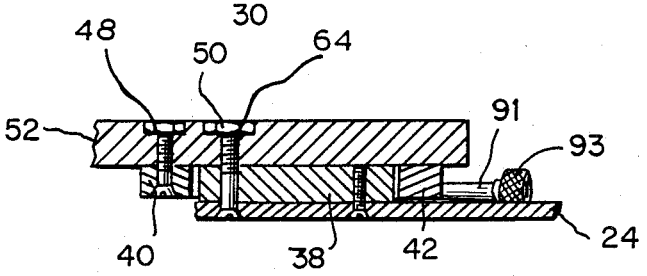
FIG. 5 is a cross-sectional view of the sidewinder exerciser of the present invention taken along line 5—5 in FIG. 2.

The typical sidewinder exerciser 10, is shown in FIGS. 2 through 4, in a most detailed manner.

The assembly begins with a man frame 24. The main frame 24 is cut to a specific configuration 26. The main frame 24 includes a top portion 28, a bottom portion 30, and an intermediate portion 32.

The top portion 28 of the main frame 24, contains a pair of steel upper belt runs 34, but is not limited to it, and a first lock pin 36.

The bottom portion 30 of the main frame 24 contains a single steel lower belt rung 33, but is not limited to it, and a second belt lock pin 37.

The intermediate portion 32 of the main frame 24, contains a round disk 38, a first caliper half 40, a second caliper half 42, and a pair of anchor screws and nuts 44.

The round disk 38 contains a first throughbore 46, and a second throughbore 48.

A metal "S"-shaped bar (offset) 52, but is not limited to it, is pivotally connected at its free end 54, to a crank handle 56, which is gripped by the user 11, by a pivot screw 58.

The fixed end 60 of the "S"-shaped metal bar (offset) 52 contains a second throughbore 62 and a first throughbore 64.

In assembly, the center bolt 50 passes through the first throughbore 64 in the "S"-shaped metal bar (offset) 52, and then into the round disk 38, and ultimately into the main frame 24.

The pivotable first caliper half 40 and the pivotable second caliper half 42 are substantially crescent shaped.

The first caliper half 40 has a fixed end 70 containing a first mounting throughbore 72 with a corresponding throughbore 74 contained in the main frame 24. A first anchor screw 82 passes through the first mounting throughbore 72 and then into the main frame 24.

The second caliper half 42 has a fixed end 76 containing a second mounting throughbore 75. A corresponding throughbore 80 is contained in the main frame 24.

A second anchor screw 84 passes through the second mounting throughbore 75.

The first anchor screw 82 passes through the first mounting throughbore 72.

The second caliper half 42 is retained from motion by the use of a lock pin 71 passing through the second caliper half 42 and into the main frame 24. The lock pin 71 on the second half caliper prevents the calipers from dragging, shifting, or chattering, etc.

The first caliper half 40 has a first flange 86 disposed on its free end 88. The first flange 86 contains a throughbore 90.

The second caliper half 42 has a second flange 92 disposed on its free end 94. The second flange 92 contains a throughbore 96.

A set screw 93, having a sleeve 91, passes through the throughbore 98 and enters the throughbore 96 where it is locked by a nut 100.

In operation, the sidewinder exerciser 10 is worn by the user 11 like gun holsters, one on the left hip and one on the right hip. The sidewinder exercisers 10 are fixed in place by three belts 12, 16, and 20 passing through steel rungs 33 and 34. One belt 12 is worn on the upper portion, like a conventional belt, and the other two belts 16 and 20 are worn on the lower portion of each sidewinder exerciser 10, around each leg. The sidewinder exerciser 10 can be slid along the belts 12, 16, and 20 for fitting different size users 11.

The user's hand, is placed on the crank handle 56, which is attached to the flat "S"-shaped metal bar 52 which is attached to the round disk 38 via a pivot bolt 50.

The crank handle 56 is swung in a circular motion, either back and forth or up and down. By turning a set screw 93, the caliper halves 40 and 42 are tightened around the round disk 38. This makes it more difficult to turn or move and therefore requires more user power to operate. The sidewinder exerciser 10 is adjustable to fit users 11 of different strengths.

The sidewinder exerciser 10 can be used: while walking or remaining stationary in a passive or active mode; to exercise muscles in the hands, lower and upper arms, shoulders, back and chest, etc.; and cardiovascular health can be improved through the use of the sidewinder exerciser 10.

It will be understood that each of the elements described above, or two or more together, may also find a useful application in other types of constructions differing from the type described above.

While the invention has been illustrated and described as embodied in a sidewinder exerciser, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters patent is set forth in the appended claims.

I claim:

1. An exerciser for a user, comprising:

(a) a main body, said main body includes a main frame, a top portion, a bottom portion, and an intermediate portion, said intermediate portion, said bottom portion contains a single lower belt rung and a second lock pin, said single lower belt rung is steel, contains a round disk, a first caliper half, a second caliper half, and a pair of anchor screws and nuts, said round disk contains a first throughbore and a second throughbore;

(b) means for attaching said main body to the user so that the user can exercise inconspicuously, said top portion contains a pair of upper belt rungs and a first lock pin, said pair of upper belt rungs are steel, said attaching means include an upper belt with a first upper buckle, a first lower belt with a first lower buckle, and a second lower belt with a second lower buckle so that the exerciser is fitted snugly to the user for inconspicuous use; and (c) an "S"-shape bar having a free end at which said "S"-shaped bar is pivotally connected to a crank handle which is gripped by the user.

2. An exerciser as defined in claim 1, wherein said "S"-shaped bar is metal.

3. An exerciser as defined in claim 2, wherein said "S"-shaped bar has a fixed end that contains a first throughbore and a second throughbore.

4. An exerciser as defined in claim 3; further comprising a center bolt that passes through said first throughbore in said "S"-shaped bar and then through said round disk and ultimately into said main frame.

5. An exerciser as defined in claim 4, wherein said first caliper half and said second caliper half are substantially crescent shaped.

6. An exerciser as defined in claim 5, wherein said first caliper half has a fixed end containing a first mounting throughbore with a corresponding throughbore contained in said main frame.

7. An exerciser as defined in claim 6, wherein a first anchor screw passes through said first mounting throughbore and into said main frame.

8. An exerciser as defined in claim 7, wherein said second caliper has a fixed end containing a second mounting throughbore with a corresponding throughbore contained in said main frame.

9. An exerciser as defined in claim 8; further comprising a second anchor screw passing through said throughbore into said second mounting throughbore, wherein an anchor screw passes through said mounting throughbore and into said main frame.

10. An exerciser as defined in claim 18, wherein said first caliper half is retained from motion by an anchor that passes through said first caliper half and into said main frame.

11. An exerciser as defined in claim 10, wherein said first caliper half includes a first flange disposed on free end of said first caliper half.

12. An exerciser as defined in claim 11, wherein said first flange contains a throughbore.

13. An exerciser as defined in claim 12, wherein said second caliper half includes a second flange disposed on free end of said second caliper half.

14. An exerciser as defined in claim 13, wherein said second flange contains a throughbore.

15. An exerciser as defined in claim 14; further comprising a set screw having a sleeve and passing through said throughbore of said first flange and said throughbore of said second flange where it is locked by a nut.

* * * * *